United States Patent [19]

Mathews et al.

[11] Patent Number: 4,677,795

[45] Date of Patent: Jul. 7, 1987

[54] FASTENING DEVICE AND METHOD

[76] Inventors: Linden H. Mathews, 3366 E. Fair Pl., Littleton, Colo. 80121; Douglas R. Crabb, 5642 W. Lakeridge Rd., Lakewood, Colo. 80227

[21] Appl. No.: 706,722

[22] Filed: Feb. 28, 1985

Related U.S. Application Data

[63] Continuation-in-part of Ser. No. 532,675, Sep. 16, 1983, abandoned.

[51] Int. Cl.[4] ..... E04B 7/14; E04B 1/12; E04B 1/347

[52] U.S. Cl. ..... 52/63; 52/222; 52/273; 52/96

[58] Field of Search ..... 160/395, 392; 244/132; 52/222, 273, 63, 96

[56] References Cited

U.S. PATENT DOCUMENTS

| | | | |
|---|---|---|---|
| 1,724,946 | 8/1929 | MacInerney | 29/526 |
| 1,886,708 | 11/1932 | Markey | 244/132 |
| 1,896,130 | 2/1933 | White | 244/132 |
| 2,164,414 | 7/1939 | Long | 244/132 |
| 4,048,533 | 4/1978 | Boyer | 52/716 |
| 4,057,095 | 11/1977 | Hirota | 160/392 |
| 4,063,393 | 12/1977 | Toti | 52/245 |
| 4,534,145 | 8/1985 | Yang et al. | 160/395 |

FOREIGN PATENT DOCUMENTS

| | | | |
|---|---|---|---|
| 125875 | 5/1919 | United Kingdom | 52/545 |

*Primary Examiner*—James L. Ridgill, Jr.
*Attorney, Agent, or Firm*—John E. Reilly

[57] ABSTRACT

A fastening device and method is disclosed for use in fixedly attaching a single-ply roof membrane to a roof structure of a building. The device comprises an elongated member formed with spaced-apart, upwardly extending arms forming an elongated channel therebetween. The elongated member is positioned on the roof surface and is fixedly attached to the roof prior to installation of the single-ply membrane. The elongated member may also be used to rigidly fix the roof insulation to the roof decking. A separate elongated plate is inserted into the elongated channel after the single-ply membrane is positioned over the roof surface. The single-ply membrane is positioned over the spaced-apart upwardly extending arms and lies within the elongated channel formed between the arms. The separate elongated plate is then positioned within the elongated channel over the single-ply membrane and the upwardly extending arms are positioned downwardly towards each other to butt each other or overlap each other, according to the embodiment used to tightly hold the single-ply membrane onto the fastening device. The method of fixedly attaching a single-ply roof membrane to an existing roof structure using the novel construction herein is also disclosed. The separate elongated plate may be formed in other configurations such as spaced-apart rods spring-loaded to provide a tight engagement with the roof membrane.

12 Claims, 11 Drawing Figures

FASTENING DEVICE AND METHOD

This application is a continuation-in-part of patent application Ser. No. 532,675, filed Sept. 16, 1983 for FASTENING DEVICE AND METHOD, by Linden H. Mathews et al, now abandoned.

This invention relates to a fastening device and method in general; and more particularly relates to a novel and improved fastening device and method for securing single-ply roof membranes to an industrial or residential building.

BACKGROUND AND FIELD OF THE INVENTION

Membrane type roofing systems are new to the industry and have created much interest among the trade. The importance to the future of the trade for single-ply roofing membranes is already becoming apparent. These systems presently constitute a low percentage of the total volume of roofing jobs being completed and it is felt that eventually the use of single-ply roofing systems will be the answer to a number of aggravating and costly problems.

Two factors dictating the trend towards a single-ply roofing system in the trade are the changes in roofing construction roof requirements along with the changing labor conditions.

In roughly four or five years, single-ply roofing systems in their many forms have captured fifteen to twenty-five percent of the commercial-industrial market with future projections calling for market shares of thirty-five to sixty percent.

As the use of single-ply roof membranes increases in the trade today, many systems are being devised for fixedly attaching the membrane to the roof. Such attaching systems may comprise the use of ballast laid on top of the loose single-ply membrane with the ballast comprising stone aggregates or other means of ballast. Another way of attaching the single-ply membrane to a roof may be the use of various types of adhesives spread between the membrane and the roofing insulation. The use of hot asphalt is also one of the methods presently being used on certain types of single-ply membranes. Contact adhesive is presently being used to adhere some single-ply membranes to the roofing system.

Other ways of fixing the single-ply membranes to a roof structure are a plurality of mechanical fasteners which are applied through the roof membrane and into the roof structure. This type of fastener then requires some type of application of cover material to be applied to the top of the fastener after it has been positioned through the membrane in order to avoid water problems inherent with the piercing of a membrane.

In the application of insulations to the roof deck of an industrial-type building, a special roof plate fastener is often used which is fixed in place with a special tool. This insulation fastener thereby serves to hold the insulation to the roof deck prior to the installation of a single-ply membrane which also must then be fastened to the roof structure. With the use of applicants' new and improved fastening device, the roof insulation fastener may be totally eliminated with the applicants' novel device functioning not only to hold the single-ply roof membrane on to the roof deck, but also to hold the roof insulation on the same deck. The savings in cost and labor for the previously used roof insulation fasteners then becomes apparent from a study of the applicants' invention as detailed in this application. In addition, applicants' fastening device lends itself well to the joining and sealing together of adjoining edges of adjacent membrane sections without the use of adhesives.

Many types of membranes are available today. The applicants' device may be used to fasten any of the three basic types, such as, the elastomeric, plastomeric and modified bitumen. Prior art fastening was determined by the particular type while the applicants' fastening is thereby universal for all types. Representative patents are U.S. Pat Nos. 1,886,708 to R. I. Markey; 1,896,130 to E. H. White; 4,057,095 to Y. Hirota; 4,063,393 to A. J. Toti and British Pat. No. 125,875 to Miller et al.

SUMMARY OF THE INVENTION

In order to overcome the problems inherent in the large numbers of systems used to apply and fasten roof membranes to the existing structure, there is provided by the applicants' present invention an embodiment of a new and improved fastening device which may be quickly applied to the roof structure over the roof insulation with the fastening device serving to retain the roof insulation in place as well as retaining the roof membrane to the device. The device comprises an elongated member formed with spaced-apart, upwardly extending arms forming an elongated channel therebetween. The elongated member is positioned on the roof structure and is fixedly attached to the roof prior to installation of the membrane over the roof's surface. The applicants' fastening device thereby is positioned completely below the single-ply roof membrane resulting in no puncturing of the roof membrane being necessary in order to fix the membrane to the roof structure.

The fastening device is broadly comprised of a plurality of generally channel-shaped elongated members defining a base and spaced-apart, upwardly directed arms, the members being disposed at spaced intervals across the roof span to be covered. At least one separate elongated plate is sized for insertion into each elongated channel between the arms after the membrane is positioned over the elongated members and the roof structure. Each of the spaced-apart, upwardly extending pair of arms are folded or bent downwardly towards each other into substantially parallel relation to the base to tightly hold the single-ply membrane within the channel of the fastening device. The arms may be joined together in a butt-type joint or may be overlapped in an overlapping joint depending upon the particular construction and size of the respective arms.

In a modified form of invention, adjoining edges of adjacent membrane sections are secured together in sealed relation utilizing the elongated member of the preferred form; specifically, the edge sections to be joined are disposed in overlapping relation to one another and in superimposed relation to the elongated member such that the overlapping sections follow the contour of the interior channel. Again, an elongated plate is disposed over the overlapping portions in the channel with an edge portion of the upper membrane section extending beyond the plate a sufficient distance that it can be folded or returned back over the upper surface of the plate as a preliminary to bending the arms downwardly to press the membrane edge sections and plate into sealed relation to one another and to the elongated member.

Preferably, the elongated member as employed in the preferred and modified forms includes a base flange or anchor plate as a unitary part of the elongated member to anchor the member to the roof deck or insulation whereby to distribute the bending forces over a wider area in bending the sides of the channel downwardly against the overlapped edges.

Accordingly, it is an object and advantage of the applicants' invention to provide for a novel and improved fastening device which may be simply formed and positioned beneath a single-ply roof membrane for attaching the membrane to the roof structure.

Another object of the applicants' invention is to provide for a novel and improved method and device for fastening a membrane to a roof without piercing or puncturing the single-ply membrane in any way, thereby providing a complete waterproof seal on the roof, and which is readily conformable for use with one or more plies of membrane and different gauges.

Still yet another object and advantage of invention is to provide a new and improved complete fastening device for use in rapidly attaching a single-ply roof membrane to a roof structure which utilizes the fastening device as a means for fastening the roof insulation to the roof decking as well as fastening the single-ply roof membrane to the roof decking.

Still yet another object and advantage of the invention is to provide a simplified fastening device for a roof membrane which eliminates many costly steps and labor in the installation of a membrane to the roof structure.

A further object and advantage of the invention is to provide a novel and improved roof structure comprised of a plurality of sheets of membranes and fastening devices interconnecting overlapping ends of said membranes in sealed relation to the roof without use of bonding agents or other special securing means.

The above and other objects, advantages and features of the present invention will become more readily appreciated and understood from the foregoing detailed description of a preferred embodiment when taken together with the accompanying drawings, in which:

DETAILED DESCRIPTION OF THE PREFERRED EMBODIMENT

Figure 1:
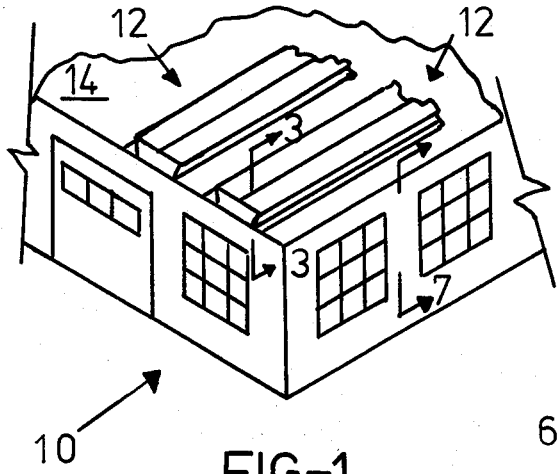
FIG. 1 is a perspective view of a corner of a building showing the applicants' new and novel fastening device utilized on the roof of a building.

Referring now to the drawings in general and in particular to FIG. 1 of the drawing there is shown a perspective view of a corner of a building 10 showing the applicants' new and novel fastening device generally by the numeral 12 utilized on the roof of the building. The roof 14 is constructed of a single-ply roof membrane of the type hereinbefore described which may be suitably composed of a rubber or rubber-like material and which is required to be fastened securely to the structural parts of the roof in order to prevent a wind uplift which may destroy the integrity of the membrane.

Figure 2:
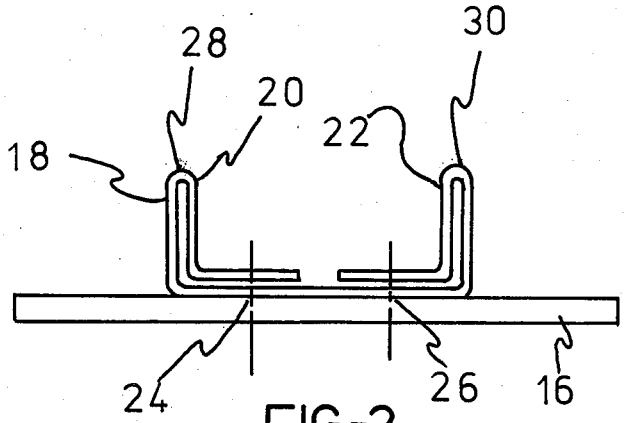
FIG. 2 is an end view showing in greater detail the preferred form of the applicants' fastening device when constructed in a twopiece construction with a base plate and an elongated member formed with spaced-apart, upwardly extending arms.

Referring to FIG. 2 of the drawing there is shown an end view of the applicants' new and novel fastening device when constructed in a two-piece construction with a base plate 16 and an elongated member 18 formed with spaced-apart, upwardly extending arms 20 and 22. In the embodiment shown in FIG. 2 the elongated member 18 is of one-piece construction with the arms 20 and 22 bent as shown in the drawing figure after which the member 18 is rigidly attached to the base plate 16 by means of spot welding at the position shown by numerals 24 and 26 or by other means of fastening. The upwardly extending arms 20 and 22 as well as the base plate 16 may be formed of galvanized steel or aluminum within the spirit and scope of the invention and may be formed of other materials suitable for the purpose. The elongated member may be formed as heretofore described in a two-piece configuration with a separate base or anchor plate 16 or may be formed in a one-piece configuration having an integral base plate attached to the spaced-apart, upwardly extending arms. It is desirable to have rounded edges 28 and 30 on the upper portion of the spaced-apart arms 20 and 22 in order to minimize tearing of the single-ply roof membrane whenever the spaced-apart arms are repositioned as will be hereinafter described. Preferably, the elongated member 18 is composed of a sheet metal or aluminum strip in which opposite sides of the strip are first folded or doubled over to define adjacent but spaced-apart confronting edges 17 then are folded once again at right angles to define the upwardly extending arms 20 and 22. In this manner, each arm 20 and 22 has an outer wall 21 and an inner wall 21' joined together at the rounded ends 28 and 30; and the inner walls 21' continue into lower flat end sections 23 which overlie common intermediate section 23' of the resultant channel and which end portions 23 terminate in the confronting edges 17.

Figure 3:
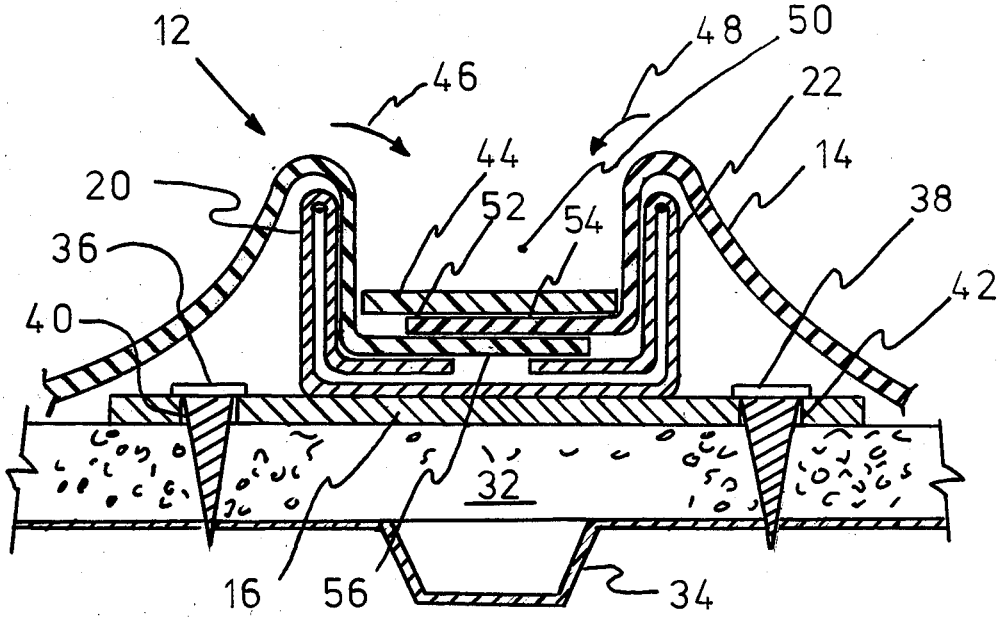
FIG. 3 is a cross-sectional view, taken along lines 3—3 of FIG. 1 showing in greater detail the applicants' new and novel fastening device further showing the device fixedly attached to the roof decking with a membrane positioned over the upwardly extending arms and below the separate elongated plate prior to bending the arms downwardly towards each other to tightly hold the single-ply membrane onto the fastening device.

Referring now to FIG. 3 of the drawing there is shown in detail a cross-sectional view, taken along lines 3—3 of FIG. 1 of the applicants' new and novel fastening device positioned on the roof insulation 32 and further showing the device fixedly attached to the roof decking 34 by means of a plurality of screws 36 and 38 positioned in a plurality of holes 40 and 42 in the base plate 16. The roof membrane 14 is positioned over the upwardly extending arms 20 and 22 and below the separate elongated plate 44 prior to bending the arms 20 and 22 downwardly and inwardly in the direction shown by the arrows 46 and 48 to tightly hold the single-ply membrane 14 beneath the separate elongated plate 44 and onto the fastening device.

The separate elongated plate 44 in the embodiment shown in FIG. 3 may be constructed of plastic, sheet metal or some other suitable material and may also be constructed in other configurations suitable to act to hold the single-ply membranes 14 beneath the plate in the position shown in FIG. 3 as an elongated retaining member. For example the elongated plate 44 may also be formed with spaced-apart rods which may be spring-biased to hold the single-ply membrane tightly within the elongated channel 50.

With the applicants' new and novel construction, it is possible to space the fastening device at an appropriate position under the membrane 14 wherein the ends 52 and 54 of the membrane are lapped together and sealed with adhesive or some other suitable material. The adhesive between the lap joint of a normal single-ply membrane is shown by the numeral 56 and at this position in the single-ply roof membrane, the weakest portion of the roof exists. By the use of the applicants' new and novel device, the weak lap joint of the roof membrane may be positioned within the applicants' device and may be tightly held by means of the elongated plate 44 thereby greatly strengthening the roof membrane. By spacing the fastening device 12 appropriately along the lap joints, then a much stronger single-ply roof is obtainable since the weak link of the roof at the lap joint is contained and clamped within the applicants' device as will be shown more clearly when referring to FIG. 4.

By the use of the applicants' device, the base plate 16 and the elongated member 18 can be positioned beneath the membrane and serve to aid in holding the insulation for the roof onto the roof decking 34. In addition the applicants' new and novel device does not require that the roof membrane be cut in any manner since the device is mainly contained beneath the membrane with only the elongated plate 44 positioned above the elongated membrane.

Figure 4:
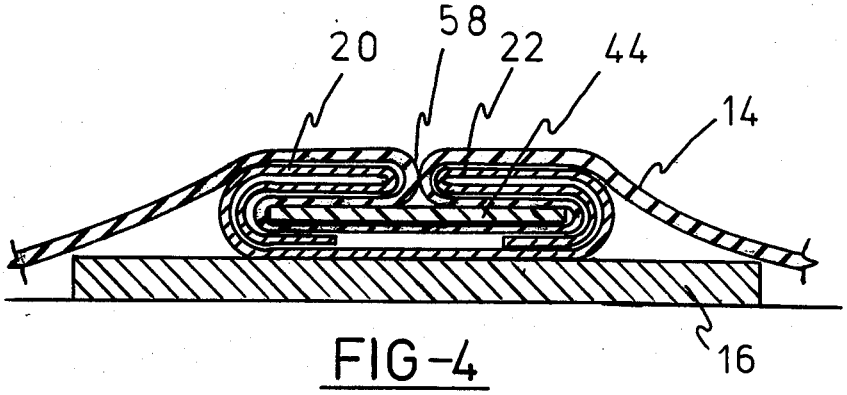
FIG. 4 is a further sectional view taken along lines 3—3 of FIG. 1 of the device shown in FIG. 3 with the arms bent downwardly in a butt-type joint to tightly hold the single-ply roof membrane onto the device and onto the roof structure.

Referring to FIG. 4 of the drawing there is shown a further sectional view taken along line 3—3 of FIG. 1 of the applicants' device shown in FIG. 3 with the arms 20 and 22 bent downwardly in a butt-type joint to tightly hold the single-ply roof membrane 14 onto the device and onto the roof structure. In FIG. 4 the screws 36 and 38 as well as the insulation 32 and the roof decking 34 have been eliminated from the drawing for purposes of clarity much as FIG. 4 is drawn primarily to show the closed and locked position of the single-ply roof membrane 14 when bent into a butt-type joint. When positioned thusly, the arms 20 and 22 are bent to allow the single-ply membrane to tightly touch or abut one another at the area shown by the numeral 58 thereby preventing moisture from entering to the internal portions of the device. Since the single-ply membrane 14 has not been severed in any way, any moisture that should accidentally enter in at point 58 will be prevented from passing any further into the roof structure and will simply lay in the area of the elongated plate 44 until it evaporates. In FIG. 4 the lap joint of the single-ply membrane has not been shown for purposes of clarity also.

Figure 5:
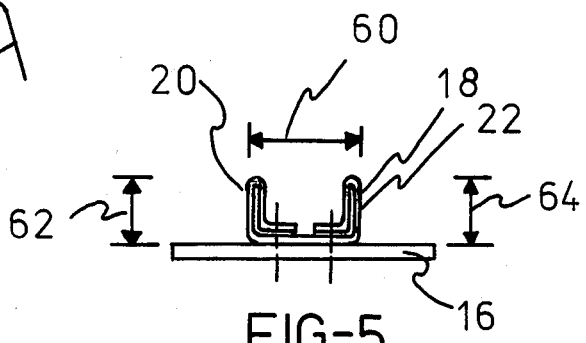
FIG. 5 is an end view of the applicants' elongated member showing in greater detail variations possible with the structure of the elongated member.
Figure 6:
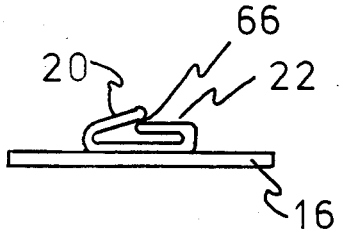
FIG. 6 is an end view of the applicants' fastening device showing the upwardly extending arms being bent downwardly and overlapped in an overlapping type joint as a modification of the basic invention.

Referring now to FIGS. 5 and 6 of the drawing there is shown in greater detail variations possible with the structure of the elongated member. When formed in the two-piece configuration of the preferred embodiment, the upwardly extending arms 20 and 22 may be formed of various lengths depending upon the type joint that is desired in the final configuration. For example if the joint required were to be a butt-type as shown in FIG. 4, then the spaced-apart arms 20 and 22 would be positioned approximately two inches apart as shown by the numeral 60 with the length of the upwardly extending arms being approximately one inch each as shown by the numerals 62 and 64.

Figure 7:
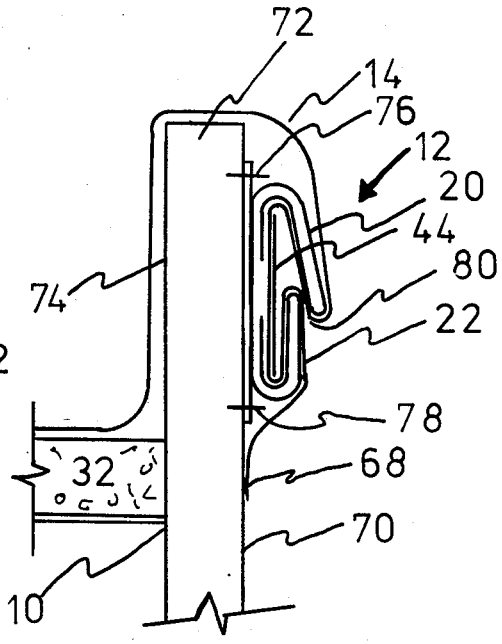
FIG. 7 is a sectional view, taken along lines 7—7 of FIG. 1 showing the use of the applicants' new and novel fastening device for fastening the ends of the roof membranes to the sides of a building.
Figure 9:
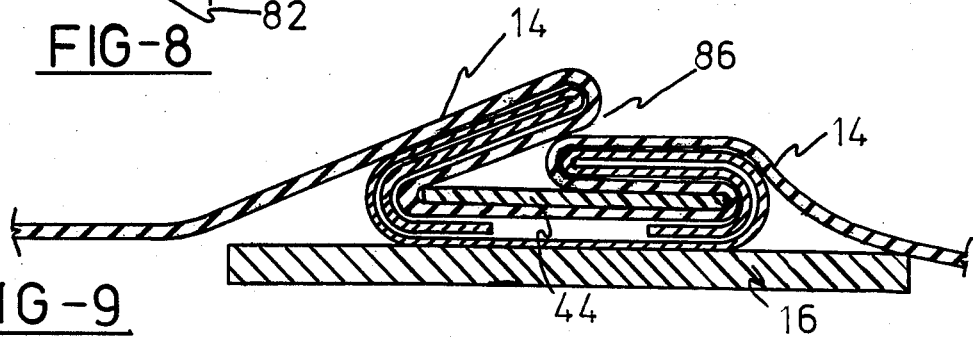
FIG. 9 is a sectional view similar to FIG. 4 showing a lap joint construction.

When it is desired to have an overlapping type of joint as shown in FIGS. 6, 7 and 9 of the drawing, then the upwardly extending arms 20 and 22 would also be formed approximately two inches apart as shown by the numeral 60 but the length of the arms 62 and 64 would then be formed approximately one and one-quarter inches long. Inasmuch as the applicants' basic device may be used on the vertical sides of a building as will be described more fully hereinafter when referring to FIG. 7 of the drawing, it is felt that the overlap-type joint would form a better and tighter joint which would be desirable.

By using a wide base plate 16 as shown in the various figures, the insulation 32 beneath the applicants' device would be protected and the device would not dig into the insulation 32 destroying the thermal effectiveness of the insulation at that point and will more effectively distribute the bending forces over a broader area when the arms are bent inwardly toward one another.

Referring to FIG. 6 of the drawing there is shown an end view of the applicants' fastening device with an overlapping type joint when the arms are bent downwardly in the direction shown by the arrows 46 and 48 of FIG. 3. For purposes of clarity, the roof membrane 14 has been eliminated from this view as well as the interior elongated plate 44. When constructed by varying the arm length 62 and 64 so as to obtain an overlapping type joint, then the arms would overlap at the area shown by the numeral 66 to tightly seal this area from entrance of water caused by weather elements. There is shown in FIG. 9 to be described hereinafter the overlapping type joint in further detail and the resultant configuration when the membrane has been added along with the elongated plate.

Referring now to FIG. 7 of the drawing a sectional view taken along line 7—7 of FIG. 1 shows the use of the applicants' fastening device 12 for fastening the ends 68 of roof membrane to the side 70 of the building 10. The applicants' fastening device 12 may be positioned as shown in FIG. 7 on the outside of the upper portion 72 of the building 10 or may also be fastened on the inside at the area shown by the numeral 74 within the spirit and scope of the invention. It may be desired to have the roof membrane 14 covered over the upper portion 72 of the building sides as shown in FIG. 7 in order to form a better seal, or to position the applicants' device 12 at the position shown by the numeral 74 in order that the roof membrane will not appear on the outside of the building. In either position, a plurality of screws 76 and 78 would attach the device to the building structure.

In FIG. 7, the applicants' device with its arms 20 and 22 has been shown in a single-line drawing for purposes of clarity and space limitations. The arms 20 and 22 are constructed in the same manner as the device is constructed as shown in FIGS. 2, 3 and 5 of the drawings. When utilizing the device on the sides of the building as shown in FIG. 7, then it would be preferable to use the overlapping type of joint thereby making a tight water seal at the overlapping point as shown by the numeral 80.

Figure 8:
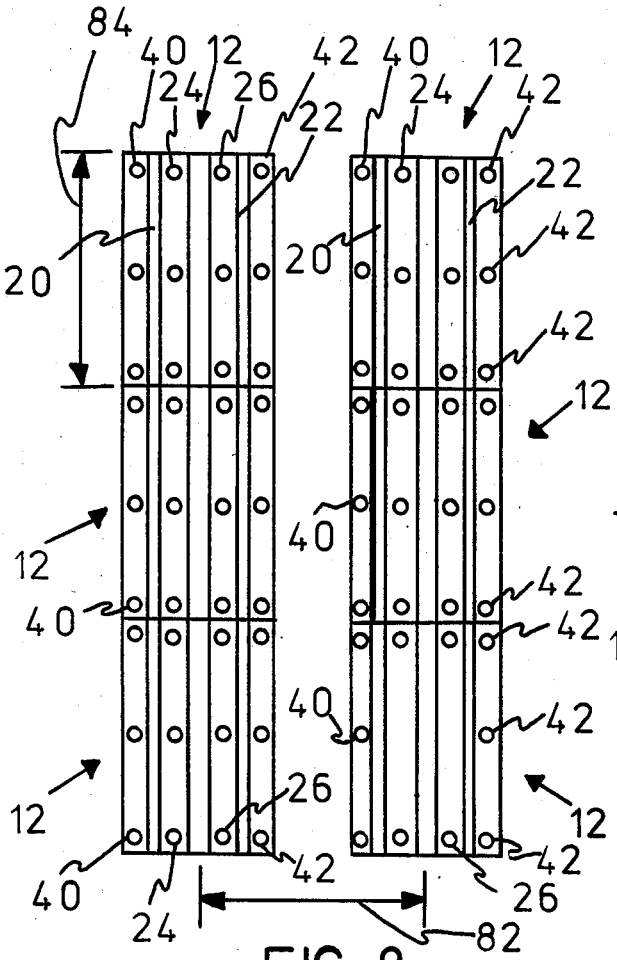
FIG. 8 is a top plan view of the roof shown in FIG. 1 showing a plurality of the applicants' new and novel fastening devices being installed on the roof prior to the installation of the single-ply roof membrane.

Referring now to FIG. 8 of the drawing, a plurality of the fastening devices 12 are positioned in spaced-apart, parallel rows on top of the building structure prior to laying down the membrane 14 on top of the roof and fastening devices. For example, the devices 12 may be spaced apart approximately five feet as shown by the numeral 82 and may be constructed in various lengths as shown by the numeral 84 such as five or six feet long or of a length to traverse the length of the roof section to be covered. The device may also be constructed with a plurality of holes 40 and 42 as shown and previously described for use in fastening the device with the plurality of screws 36 and 38 to the roof decking 34. As has been previously mentioned the upwardly extending arms 20 and 22 can be fixedly attached to the base member 16 by means of a plurality of spot welds 20 and 26 or some other fastening means within the spirit and scope of the invention. The base member 16 has not been shown in FIG. 8 for clarity.

Referring now to FIG. 9 of the drawing, a sectional view similar to FIG. 4 shows the lapped joint construction of the device when positioned horizontally on the roof in lieu of the butt type construction shown in FIG. 4 of the drawings. When constructed thusly it can be seen that a tight joint is available at the area shown by the numeral 86 to prevent water from entering into the interior of the device in proximity to the elongated retaining member or plate 44. For purposes of clarity, the insulation 32 of the roof and the roof deck 34 have been eliminated from FIG. 9.

Figure 10:
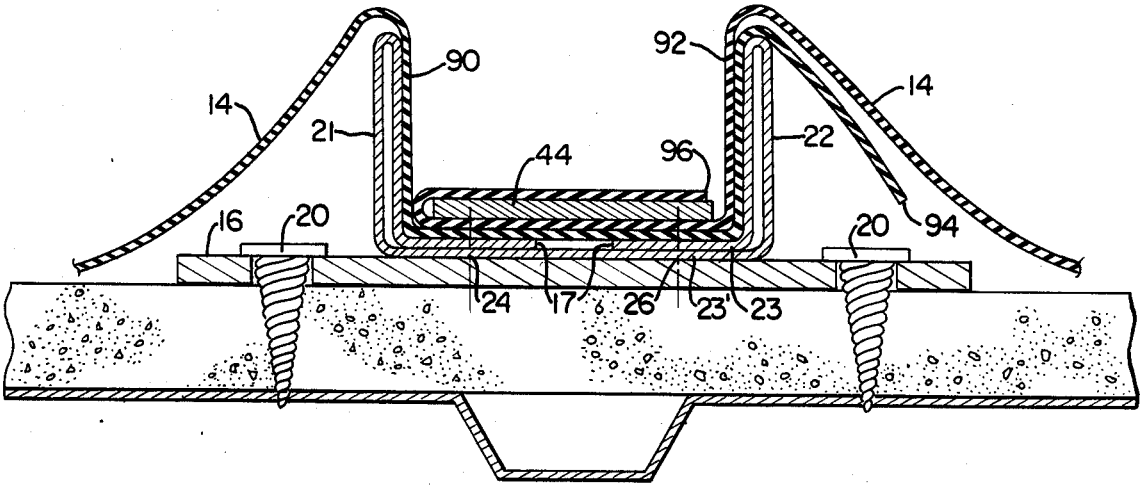
FIG. 10 is a cross-sectional view of a modified form of joint in accordance with the present invention.
Figure 11:
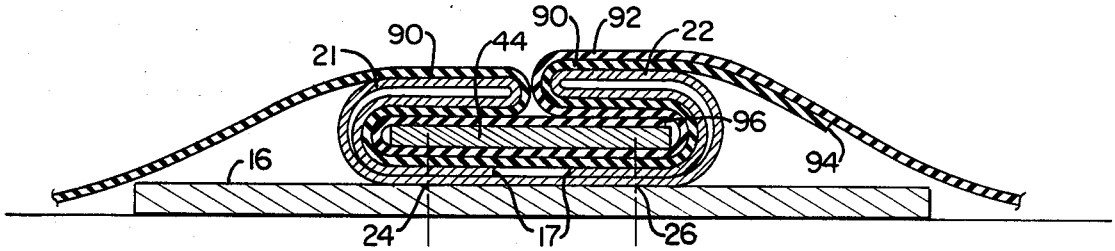
FIG. 11 is a cross-sectional view of the modified form of joint shown in FIG. 10 with the arm bent downwardly into a butt-type joint.

In the modified form of joint construction illustrated in FIGS. 10 and 11, the elongated member is formed in the same manner as described with reference to FIGS. 1 to 9 for use in sealing together overlapping ends 52' and 54' in such a way as to obviate use of an adhesive or other bonding material. To this end, the elongated member is formed in the same manner as described with reference to FIGS. 1 to 10 with fasteners 24 and 26 which are secured at spaced intervals to extend downwardly through the end portions 23 and intermediate section 23' into the base plate 16 so as to prevent the free edges 17 from bending or curling upwardly. Again, the fasteners 24 and 26 may take the form of spot welding the layers together at closely spaced intervals on the order of 3" apart. Adjoining membranes 14 have overlapping ends 90 and 92, the end portion 90 extending entirely around the inner wall and inner walls of the arms 20 and 22 and intermediate section 23 to terminate in a free edge 94 externally of the arm 22. The overlapping end 92 is disposed over the end portion 90 so as to extend for the same distance around the interior of the channel and to terminate in a free edge 96. An elongated plate 44 is positioned to rest on the end portion 92 and the edge portion 96 is then doubled over the elongated plate to substantially cover the surface of the plate 44. Opposite sides or arms 20 and 22 are then bent inwardly toward one another and downwardly in the same manner as described in reference to FIG. 4 so as to complete the joint. In this relationship, it will be noted that underlying end portions 90 traverse the full extent of the interior channel as well as the outer wall sections 21 of both arms 20 and 22 and the upper membrane portion 92 overlaps the membrane portion 90 throughout the interior channel as well as to form a covering over the elongated plate. When the membranes are sandwiched together with the elongated plate 44, a complete moisture-proof seal is thereby formed throughout the joint to prevent leakage past or beyond the opposite free ends 94 and 96 of the membranes. As in the preferred form, the base plate 16 serves as a means of attachment of the elongated member into the roof insulation or roof decking so as to distribute the bending loads or forces of the arms 20 and 22 over a wider area.

With the applicants' roof structure, experiments have been run with wind uplift tests on the device and uplift pressure of up to 105 psi have been held for one minute with this device as compared to previous devices having less ability to hold the single-ply membrane to the test structure. Accordingly it is felt that the applicants' new and novel device herein described has much improved features making it suitable for use in industrial buildings, residential buildings and other types of buildings than heretofore possible with prior art devices.

From the foregoing it should become apparent that changes may be made in the arrangement of parts of the structure, the layout of the device on the roof and other variations within the spirit and scope of the invention. The spacing of the device on the roof may be varied according to the purchaser's desires and the particular type of membrane. The applicants' device may be used to cover and strengthen existing single-ply membrane lap joints as has been heretofore described thereby making the entire single-ply membrane much stronger with the use of the applicants' device.

Nevertheless changes may be made in the arrangement of parts and the steps of the method without departing from the spirit and scope of the invention which has been shown in the preferred embodiment and variations thereafter by way of illustration only.

We claim:

1. A roof structure for a building having an exterior surface to be covered, comprising in combination:

at least one membrane composed of a flexible, water-repellant sheet, said sheet defining a roof covering applied over said exterior surface; and a plurality of fastening devices interposed at spaced intervals between said membrane and said exterior surface of said roof structure, each said fastening device including an elongated base member attached to said exterior surface and a pair of elongated, bendable arms extending upwardly from opposite sides of said base member, said arms being bendable about said base member between a first position defining a channel therebetween and a second position in which said arms extend inwardly with portions of said membrane covering free ends of said arms, and said arms extending parallel to said base member with said portions of said membrane touching one another a portion of said membrane disposed in each said channel to extend along inner facing surfaces of said arms and said base member when said arms are disposed in said first position, and said membrane portion fixed between said arms and said base member when said arms are bent into said second position.

2. A roof structure according to claim 1, including a substantially rigid retainer member interposed between said spaced-apart arms and said membrane within each said channel.

3. A roof structure according to claim 2, said retainer member defined by an elongated plate.

4. A roof structure according to claim 1, there being a pair of membranes having overlapping end portions, one of said end portions extending over said bendable arms and the interior of said channel of each fastening device, and the other of said end portions extending over one of said arms and interior of said channel of each fastening device in overlapping relation to said one end portion.

5. A roof structure according to claim 4, including an elongated plate disposed in each channel over said overlapping end portions of said membranes.

6. A roof structure according to claim 5, said other end portion including a free edge at least partially overlying said elongated plate.

7. In a roof structure for a building having an exterior surface to be covered wherein a plurality of membranes having overlapping end portions define a roof covering applied to said exterior surface, the combination therewith comprising:

a plurality of fastening devices interposed at spaced intervals between each of said overlapping end portions of said membranes and said exterior surface of said roof, each said fastening device including an elongated base member attached to said roof and a pair of spaced-apart arms protruding from said base member and defining a channel therebetween, said overlapping end portion of each said membrane disposed in each said channel to extend along inner facing surfaces of said arms and said base member, a retainer member interposed between said arms and said base member, said spaced arms extending inwardly toward one another and against said retainer member with said overlapping end portions fixed between said arms and said base member.

8. In a roof structure according to claim 7, said arms defined by a sheet metal strip doubled upon itself and folded into the form of a U-shaped channel portion.

9. In a roof structure according to claim 8, said strip having opposite sides folded inwardly to define outer rounded ends on each said arm and confronting edges in the interior of said channel.

10. In a roof structure according to claim 7, one of said overlapping end portions extending over said spaced-apart arms and the interior of said channel and the other of said overlapping end portions extending over one of said arms and interior of said channel in overlapping relation to said one end portion.

11. In a roof structure according to claim 10, said retainer member defined by an elongated plate disposed in each channel over said overlapping end portions of said membranes.

12. In a roof structure according to claim 10, said other overlapping end portion including a free edge at least partially overlying said elongated plate.

* * * * *